US007883226B2

(12) United States Patent
Li

(10) Patent No.: US 7,883,226 B2
(45) Date of Patent: Feb. 8, 2011

(54) LED SIGNAL LAMP

(75) Inventor: Yi-Qun Li, Danville, CA (US)

(73) Assignee: Intematix Corporation, Fremont, CA (US)

( * ) Notice: Subject to any disclaimer, the term of this patent is extended or adjusted under 35 U.S.C. 154(b) by 0 days.

(21) Appl. No.: 11/906,146

(22) Filed: Sep. 28, 2007

(65) Prior Publication Data

US 2008/0218993 A1 Sep. 11, 2008

Related U.S. Application Data

(63) Continuation-in-part of application No. 11/714,464, filed on Mar. 5, 2007.

(51) Int. Cl.
*F21V 9/16* (2006.01)

(52) U.S. Cl. ..... 362/84; 362/85; 362/800

(58) Field of Classification Search ..... 362/84, 362/85, 800

See application file for complete search history.

(56) References Cited

U.S. PATENT DOCUMENTS

| | | | | |
|---|---|---|---|---|
| 5,947,587 | A | 9/1999 | Keuper et al. | |
| 6,120,909 | A | 9/2000 | Bojarczuk, Jr. et al. | |
| 6,203,391 | B1 * | 3/2001 | Murasko | 445/24 |
| 6,466,135 | B1 | 10/2002 | Srivastava et al. | |
| 6,513,949 | B1 * | 2/2003 | Marshall et al. | 362/231 |
| 6,555,958 | B1 * | 4/2003 | Srivastava et al. | 313/506 |
| 7,246,923 | B2 | 7/2007 | Conner | |
| 2004/0252520 | A1 * | 12/2004 | Martineau et al. | 362/545 |
| 2005/0200271 | A1 | 9/2005 | Juestel et al. | |
| 2006/0027786 | A1 | 2/2006 | Dong et al. | |
| 2006/0028122 | A1 | 2/2006 | Wang et al. | |
| 2006/0145123 | A1 | 7/2006 | Li et al. | |
| 2006/0158090 | A1 | 7/2006 | Wang et al. | |
| 2006/0261309 | A1 | 11/2006 | Li et al. | |
| 2006/0262532 | A1 | 11/2006 | Blumel | |
| 2007/0029526 | A1 | 2/2007 | Cheng et al. | |
| 2007/0091601 | A1 | 4/2007 | Hsieh et al. | |

OTHER PUBLICATIONS

International Search Report and Written Opinion dated Aug. 1, 2008 for International Application No. PCT/US2008/060404, 7 pages.

* cited by examiner

*Primary Examiner*—Sandra L O Shea
*Assistant Examiner*—Jessica L McMillan
(74) *Attorney, Agent, or Firm*—Fliesler Meyer LLP

(57) ABSTRACT

An LED signal lamp (100) comprises: a housing (102), at least one LED excitation source (108) operable to emit excitation radiation of a first wavelength range (blue light), at least one phosphor material (114) for converting at least a part of the excitation radiation to radiation of a second wavelength range and a substantially transparent cover (104) provided on the housing opening. In one arrangement the excitation source (LED chip) incorporates the phosphor material. Alternatively, the phosphor can be provided remote to the excitation source such as for example on a transparent substrate which is disposed between the excitation source and transparent cover. In other arrangements, the phosphor is provided on the transparent cover or other optical components as a layer on a surface of the cover or incorporated within the cover/optical component material.

30 Claims, 14 Drawing Sheets

LED SIGNAL LAMP

CROSS REFERENCE TO RELATED APPLICATION

This application is a Continuation-in-Part of U.S. patent application Ser. No. 11/714,464, Mar. 5, 2007, the specification and drawings of which are incorporated herein by reference.

BACKGROUND OF THE INVENTION

1. Field of the Invention

The invention relates to light emitting diode (LED) based signal lamps and in particular to systems in which a phosphor, photo luminescent material, is used to generate a desired color of light. Moreover, the invention concerns LED signal lamps or light modules for traffic lights and signal lights.

2. Description of the Related Art

Traffic lights, also known as traffic signals, stop lights etc. for vehicles and pedestrians are well known and comprise red and green signal lamps in which red denotes stop and green (sometimes white for pedestrian walk symbols) denotes go. Often vehicle traffic signals include an amber signal lamp to indicate to prepare to stop. Signal lamps generally comprise an open housing/casing containing a light source, traditionally an incandescent light bulb, and a front tinted convex cover lens which is in the form of a colored filter. The front cover lens is often fabricated from a hard abrasion resistant plastics material with a lens structure formed on its inner surface to act as an optical condenser with the filament of the lamp placed at the focal point of the optical condenser such that the lamp projects light to a focal point at infinity. Such lamps produce very high intensity light within a standardized narrow solid angle enabling them to be observed at a distance even in bright ambient light. The front cover which is generally convex in shape is often tinted to reduce glare and the reflection of sun light. The different signal colors/hue for automotive, aviation, rail, nautical and other applications are specified by various government agencies and trade organizations in terms of their x and y chromaticity coordinates on the CIE (Commission Internationale d'Eclairage) chromaticity diagram. For example in the USA the Institute of Transportation Engineers (ITE) specifies the color specifications for vehicle and pedestrian traffic signals, the Federal Aviation Administration (FAA) specifies aviation ground light colors, the International Civil Aviation Organization (ICAO) specifies aeronautical ground light colors, the Engineering society for advancing mobility land sea air and space (SAE) specifies ground vehicle lighting color standards and the American Railway Engineering and Maintenance-of-way Association (AREMA) specifies color signal specifications for railroad applications.

The development of high intensity LEDs having lower power consumption, lower heat generation and longer operating lives compared to incandescent sources has led to a new generation of LED based signal lamps. Currently, LED signal lamps utilize an array of color LEDs. The LED array can contain many hundreds of LEDs, typically 200-600 standard intensity (e.g. 40 to 120 mW) LEDs distributed over the entire surface of the lamp module or an array of 18 to 24 high intensity (e.g. 1 W), flux, LEDs concentrated about the central axis of the lamp module. For example InGaN, GaAlAs and AlInGaP based LEDs are respectively used to generate red (610 nm), green (507 nm) and amber (590 nm) light. In such systems the front cover lens is often tinted or incorporates a complimentary color filter.

A problem with LED based traffic signals is thermal stability. For example the intensity of light output of an AlInGaP amber LED will drop nearly 75% over an operating temperature range of 20 to 80° C. Although red and green LEDs have a relatively lower drop off in intensity, the wavelength (color) changes with temperature. As a result LED signal lamps will often incorporate a feedback circuit to minimize their wavelength temperature dependency.

A further problem with LED based traffic signals is that a failure of one or more of the LEDs can lead to problems of intensity uniformity across the lamp surface. U.S. Pat. No. 5,947,587 teaches using a Fresnel lens as a spreading window for an LED signal lamp to provide an optimum, homogeneous brightness distribution of output light. The Fresnel lens is positioned between the LED array and an outer cover. The LEDs are clustered around the axis of the lamp to ensure that failure of one or more LEDs has little or no effect on the output light.

Conversely, US 2007/0091601 describes an LED traffic light structure having an array of LEDs which are spread over substantially the entire light emitting surface area of the lamp. A front cover which comprises multiple rectangular lenses is provided over the LEDs and an inner cover sandwiched between the front cover and the LEDs and comprising columns symmetrically arranged relative to a central axis on an emergence surface of the inner cover. Light scattered and reflected by the inner cover is inclined downwards to a horizontal axis of the front cover to thereby reduce color difference in the emitted light.

US 2006/0262532 concerns an optical condenser for use in an LED signal lamp. The LEDs are provided as an array on a base plate and the lamp configured such as to deliberately de-focus the emitted light. De-focusing can be achieved by locating the LEDs at the focal plane of the condenser and the condenser has a configuration of optical structures, such as spherical lenses, to de-focus the light. Alternatively the LED array, base plate, is located slightly away from the focal plane of the optical condenser.

For pedestrian crossing signals, such as ones in which a white pedestrian walk symbol and red raised hand symbol denote "walk" or "cross" and "wait" or "do not cross" respectively, the "wait" symbol can be operational virtually twenty four hours a day seven days a week and in hot climates it is found that the red LEDs used to generate the symbol can have thermal stability problems and have to be replaced. Secondly, since the symbols are generated by an array of LEDs configured in the form of the required symbol, failure of one or more LEDs leads to an appreciable degradation of the symbol's appearance.

SUMMARY OF THE INVENTION

The object of the invention is to provide a signal lamp which is based on solid-state components, namely LEDs, and which at least in part has an improved color uniformity, enhanced color saturation of output light and a lower susceptibility to degradation in the event of the failure of one or more LEDs.

The invention is based on generating the required color of light, most commonly red, amber, green or white, using a phosphor (photo luminescent) material which is excited by radiation from an associated LED excitation source. In one arrangement the phosphor is incorporated in the LED chip and such an arrangement is found to be have an improved thermal stability compared to the known signal lamps which utilize LEDs without phosphor enhancement. Alternatively the phosphor can be provided remotely to the LED excitation source. In contrast to known white LEDs which incorporate a small surface area of phosphor, typically a millimeter squared ($mm^2$) or so, in contact with the LED die/chip, the phosphor of the lamp of the invention can be provided as a relatively large surface area, of the order of a thirty thousand $mm^2$ or more. A large surface area of phosphors enables an improved color uniformity and saturation to be achieved. Moreover, failure of one or more LEDs has virtually no effect on color uniformity since light is generated homogeneously by the phosphor material. Additionally, the invention reduces fabrication costs since a common lamp module can be constructed which utilizes a single color of LED, typically blue or UV, and the signal lamp color is determined by the phosphor material inserted into the module.

According to the invention an LED signal lamp comprises: a housing, at least one LED excitation source operable to emit excitation radiation of a first wavelength range, at least one phosphor material for converting at least a part of the excitation radiation to radiation of a second wavelength range and a substantially transparent cover provided on the housing opening.

In one arrangement the at least one LED excitation source incorporates the at least one phosphor material.

In an alternative arrangement the at least one phosphor material is provided remote to the at least one LED excitation source and is preferably disposed between the at least one LED excitation source and the transparent cover. The phosphor can be provided on a transparent substrate, such as for example an acrylic sheet, which is disposed between the excitation source and the transparent cover. The phosphor can be provided as one or more layers on a surface of the transparent substrate or incorporated in the substrate material.

In a further arrangement the phosphor is provided on the transparent cover as one or more layers on a surface of the cover or is incorporated in the cover material. In such an arrangement the phosphor can define a device or symbol such as a raised hand, a pedestrian walking device, an arrow or cross etc. Such devices/symbols can be fabricated by screen printing the phosphor onto the front cover.

The signal lamp advantageously further comprises an optical condenser (lens arrangement) for focusing light emitted by the lamp. The optical condenser can comprise a lens structure, such as a Fresnel lens arrangement, formed on a surface of the transparent cover.

Alternatively or in addition, the signal lamp can further comprise an optical element disposed between the phosphor and cover, the optical element configured in conjunction with the lens structure to direct light in a desired direction or pattern.

Preferably, the at least one LED excitation source comprises a blue/UV emitting LED. The signal lamp can be configured to generate red, orange, amber, green, white or blue light depending on the amount and type of phosphor material.

The phosphor can comprise any inorganic phosphor material such as for example a silicate-based phosphors of general composition $A_3Si(O,D)_5$ or $A_2Si(O,D)_4$ where A=Sr, Ba, Mg or Ca and D=Cl, Fl, N or S; an aluminate-based phosphor, a nitride or sulfate phosphor material; an oxy-nitride or oxy-sulfate phosphor or garnet material (YAG).

The signal lamp of the invention finds particular application as a vehicle traffic signal, a pedestrian traffic signal, a railway traffic signal, an aeronautical ground light or an aviation ground light.

BRIEF DESCRIPTION OF THE DRAWINGS

In order that the present invention is better understood embodiments of the invention will now be described, by way of example only, with reference to the accompanying drawings in which.

DETAILED DESCRIPTION OF THE INVENTION

Figure 1:
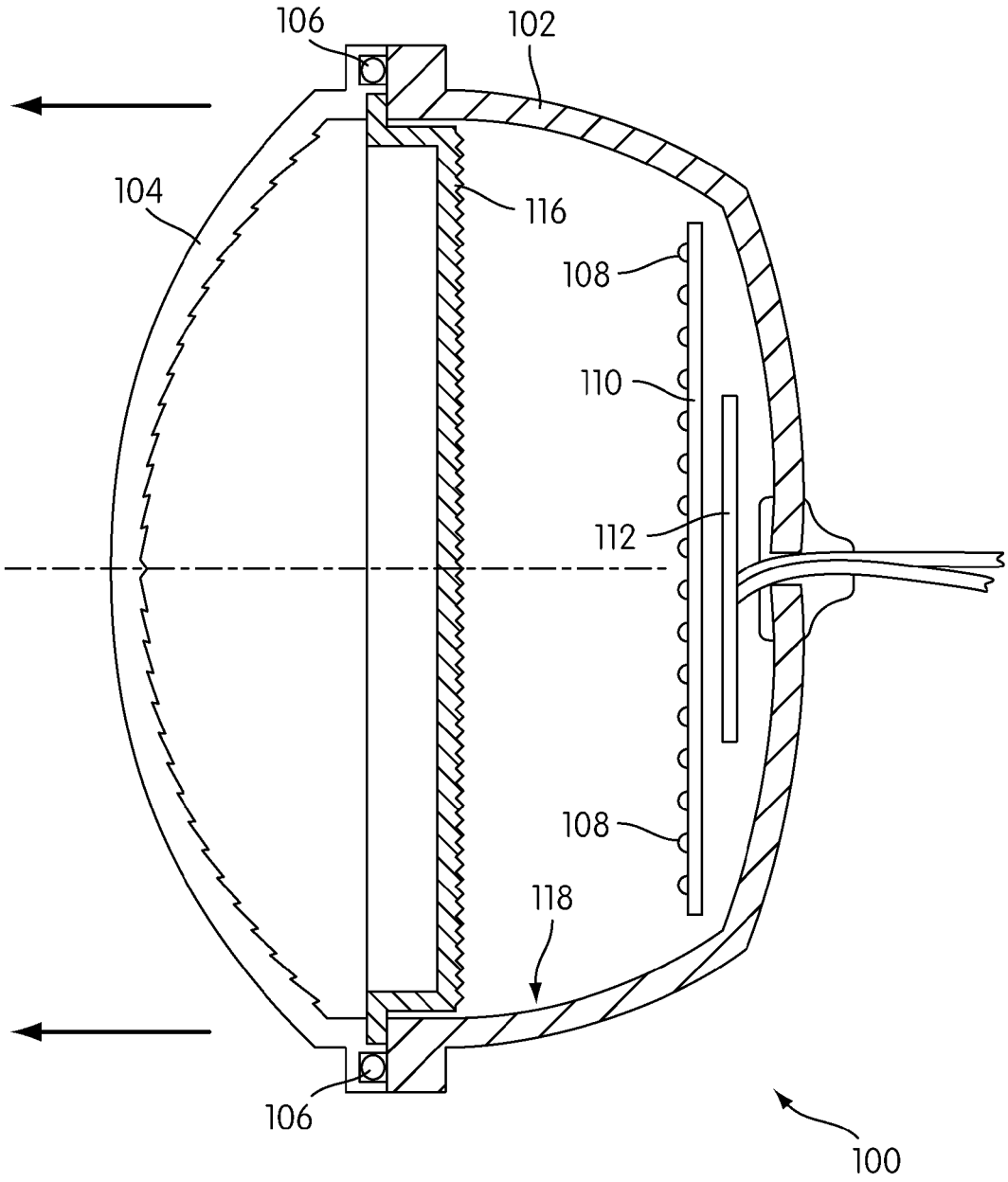
FIG. 1 is a schematic cross-sectional representation of an LED signal lamp or LED traffic light module in accordance with the invention.

Referring to FIG. 1 there is shown a schematic cross-sectional representation of a circular LED signal lamp 100 in accordance with the invention. The LED signal lamp or LED traffic light module 100 can be used in traffic signal lights for pedestrians, vehicles including automobiles, trucks, trains, aircraft and boats or as a signal lamp indicating for example port and starboard onboard a ship or as an indicator signal lamp. For vehicular traffic applications in the USA the lamp module will typically be 8 inches (200 mm) or 12 inches (300 mm) in diameter.

The lamp 100 comprises a casing/housing 102, a front cover lens 104, a moisture seal 106, an array of LEDs 108, a circuit board 110, a power supply/LED driver circuitry 112 and optionally a secondary lens arrangement 116. The casing 102 which can be shallow dish shaped in form can be molded from a polycarbonate or other plastics material, and preferably has a light reflecting inner surface 118. The transparent circular front cover lens 104 is provided over the front opening of the casing 102 and the moisture seal 106 is provided around the periphery of the cover to prevent ingress of moisture into the lamp module 100. The cover lens 104 can be fabricated from a polycarbonate, glass or transparent plastics material and can be tinted to reduce glare and sun reflection and/or include a hard coating for abrasion resistance. Additionally, the front cover lens can comprise a color filter of complimentary color to the signal lamp. The front cover lens 104 which is typically convex in form has its inner surface profiled to define a lens structure for focusing at infinity the light emitted by the lamp module. Suitable lens structures, such as for example a Fresnel type lens structure, will be readily apparent to those skilled in the art and are consequently not described further. The moisture seal 106 may comprise a silicone rubber.

The array of LEDs 108 is mounted on the circuit board 110. Typically each LED comprises an InGaN/GaN (indium gallium nitride/gallium nitride) based LED chip which generates blue/UV light of wavelength 400 to 450 nm/365 to 480 nm. Each LED further includes a phosphor (photo luminescent or wavelength conversion) material which converts at least a part of the radiation (light) emitted by the chip into light of a longer wavelength. The light emitted by the chip combined with the light emitted by the phosphor gives the required color of emitted light. The phosphor can be incorporated into the LED by encapsulating the light emitting surface of the LED chip with a transparent silicone in which the powdered phosphor is dispersed. In one arrangement the array comprises 24 high power (1 watt) LEDs. In an alternative arrangement the array comprises 400 low power (60 mW) LEDs, both arrangements giving a total output power of 24 W. In the embodiment illustrated the LEDs 108 are evenly distributed over the entire surface of the circuit board 110 which has a surface area substantially corresponding to the surface area of the front cover lens. As a consequence the secondary lens arrangement 116 is required to achieve a desired beam pattern in conjunction with the front cover lens. It will be appreciated that the number, type, power and geometric arrangement of the LEDs can be tailored to suit the required application.

The LED signal lamp of the invention can be configured as a red (610 nm), amber/yellow (590 nm), green (507 nm) or white signal lamp by appropriate selection of the phosphor material or a mixture of phosphor materials. FIGS. 8 to 13 are CIE chromaticity diagrams respectively indicating ITE color specifications for vehicle and pedestrian traffic signals; FAA MIL-C-2505A aviation ground light colors; ICAO aeronautical ground light colors; SAE J578 ground vehicle lighting color standards; AREMA color signal specification; and European Standard EN12368:2000 traffic signal color requirement. Tables 1 to 6 tabulate the color equations for the chromaticity diagrams of FIGS. 8 to 13. Tables 7 and 8 respectively define Hi Flux LED module and 12V LED module specifications for the USA. Signal lamps in accordance with the invention can be fabricated to meet the above specifications by appropriate selection of the phosphor material(s) and the number and intensity of LEDs used to excite the phosphor.

The phosphor can comprise a silicate-based phosphor of a general composition $A_3Si(O,D)_5$ or $A_2Si(O,D)_4$ in which Si is silicon, O is oxygen, A comprises strontium (Sr), barium (Ba), magnesium (Mg) or calcium (Ca) and D comprises chlorine (Cl), fluorine (Fl), nitrogen (N) or sulfur(S). Examples of silicate-based phosphors are disclosed in our co-pending patent applications US2006/0145123, US2006/028122, US2006/261309 and US2007029526 the content of each of which is hereby incorporated by way of reference thereto.

As taught in US2006/0145123 a europium ($Eu^{2+}$) activated silicate-based green phosphor of general formula $(Sr,A_1)_x(Si,A_2)(O,A_3)_{2+x}:Eu^{2+}$ in which: $A_1$ is at least one of a 2+ cation, a combination of 1+ and 3+ cations such as for example Mg, Ca, Ba, zinc (Zn), sodium (Na), lithium (Li), bismuth (Bi), yttrium (Y) or cerium (Ce); $A_2$ is a 3+, 4+ or 5+ cation such as for example boron (B), aluminum (Al), gallium (Ga), carbon (C), germanium (Ge), N or phosphorus (P); and $A_3$ is a 1-, 2- or 3-anion such as for example F, Cl, bromine (Br), N or S. The formula is written to indicate that the $A_1$ cation replaces Sr; the $A_2$ cation replaces Si and the $A_3$ anion replaces O. The value of x is an integer or non-integer between 2.5 and 3.5.

US2006/028122 discloses a silicate-based yellow-green phosphor has a formula $A_2SiO_4:Eu^{2+}$ D, where A is at least one of a divalent metal comprising Sr, Ca, Ba, Mg, Zn or cadmium (Cd); and D is a dopant comprising F, Cl, Br, iodine (I), P, S and N. The dopant D can be present in the phosphor in an amount ranging from about 0.01 to 20 mole percent. The phosphor can comprise $(Sr_{1-x-y}Ba_xM_y)SiO_4:Eu^{2+}F$ in which M comprises Ca, Mg, Zn or Cd.

US2006/261309 teaches a two phase silicate-based phosphor having a first phase with a crystal structure substantially the same as that of $(M1)_2SiO_4$; and a second phase with a crystal structure substantially the same as that of $(M2)_3SiO_5$ in which M1 and M2 each comprise Sr, Ba, Mg, Ca or Zn. At least one phase is activated with divalent europium ($Eu^{2+}$) and at least one of the phases contains a dopant D comprising F, Cl, Br, S or N. It is believed that at least some of the dopant atoms are located on oxygen atom lattice sites of the host silicate crystal.

US2007/029526 discloses a silicate-based orange phosphor having the formula $(Sr_{1-x}M_x)_yEu_zSiO_5$ in which M is at least one of a divalent metal comprising Ba, Mg, Ca or Zn; $0<x<0.5$; $2.6<y<3.3$; and $0.001<z<0.5$. The phosphor is configured to emit visible light having a peak emission wavelength greater than about 565 nm.

The phosphor can also comprise an aluminate-based material such as is taught in our co-pending patent applications US2006/00158090 and US2006/0027786 the content of each of which is hereby incorporated by way of reference thereto.

US2006/0158090 teaches an aluminate-based green phosphor of formula $M_{1-x}Eu_xAl_yO_{[1+3y/2]}$ in which M is at least one of a divalent metal comprising Ba, Sr, Ca, Mg, Mn, Zn, Cu, Cd, Sm and thulium (Tm) and in which $0.1<x<0.9$ and $0.5\leqq y\leqq 12$.

US2006/0027786 discloses an aluminate-based phosphor having the formula $(M_{1-x}EU_x)_{2-z}Mg_zAl_yO_{[1+3y/2]}$ in which M is at least one of a divalent metal of Ba or Sr. In one composition the phosphor is configured to absorb radiation in a wavelength ranging from about 280 nm to 420 nm, and to emit visible light having a wavelength ranging from about 420 nm to 560 nm and $0.05<x<0.5$ or $0.2<x<0.5$; $3\leqq y\leqq 12$ and $0.8\leqq z\leqq 1.2$. The phosphor can be further doped with a halogen dopant H such as Cl, Br or I and be of general composition $(M_{1-x}Eu_x)_{2-z}Mg_zAl_yO_{[1+3y/2]}$:H.

It will be appreciated that the phosphor is not limited to the examples described herein and can comprise any inorganic phosphor material including for example nitride and sulfate phosphor materials, oxy-nitrides and oxy-sulfate phosphors or garnet materials (YAG).

Figure 2A:
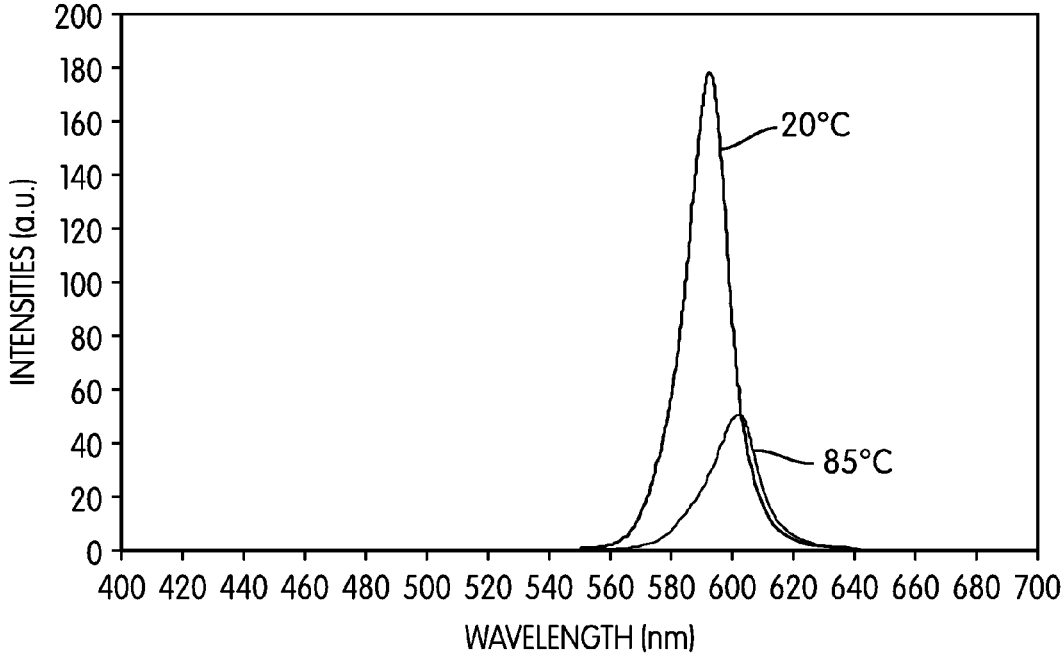
FIGS. 2*a* and 2*b* are emission spectra (intensity versus wavelength) for (a) an AlInGaP based amber LED at 20° C. and 85° C. and (b) an amber LED signal lamp in accordance with the embodiment of FIG. 1.
Figure 2B:
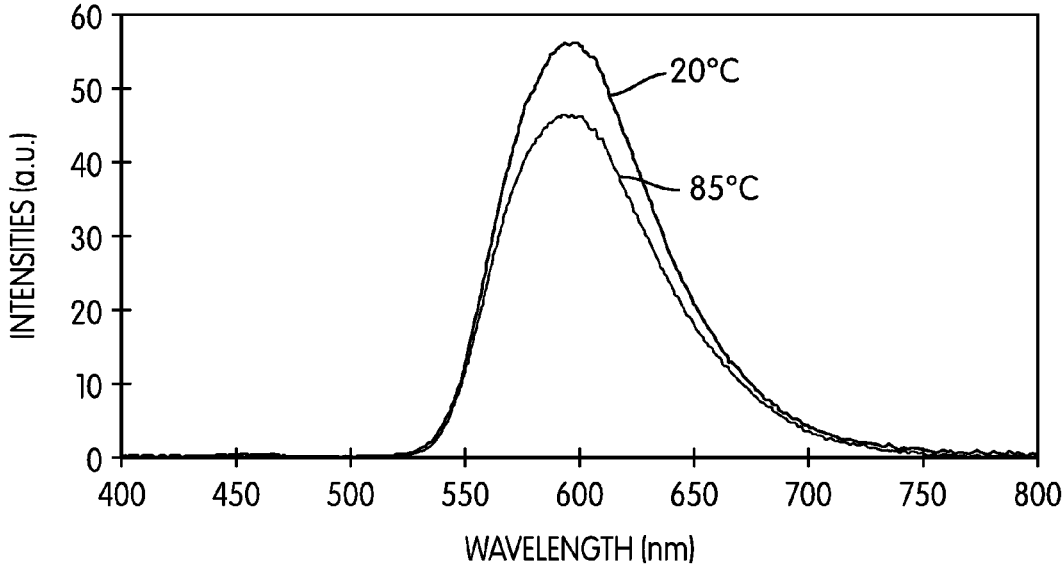

FIG. 2 shows, the emission spectra (intensity versus wavelength) for (a) an AlInGaP based amber LED at 20° C. and 85° C. and (b) an amber LED signal lamp in accordance with the invention in which a blue LED chip incorporates an orange phosphor. As can be seen in FIG. 2*a* the intensity of a conventional AlInGaP orange LED drops nearly 75% for operating temperatures between 20 and 85° C. In contrast, as indicated in FIG. 2*b*, the orange signal lamp of the invention drops only 14% over the same operating temperature range.

Figure 3:
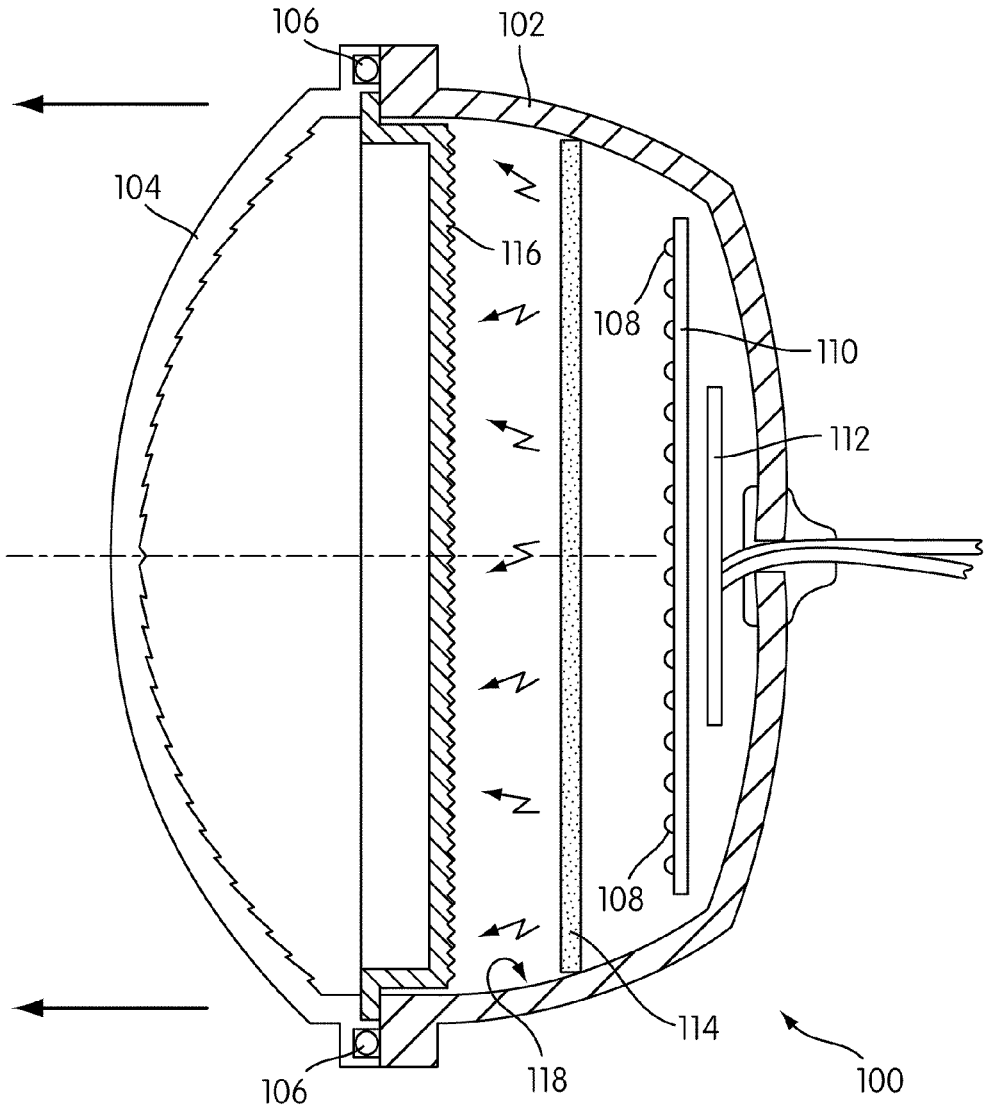
FIG. 3 is a schematic cross-sectional representation of an LED traffic light module in accordance with a further embodiment of the invention in which a phosphor material is provided remote to an LED excitation source.

Referring to FIG. 3 there is shown a signal lamp in accordance with a further embodiment of the invention in which the phosphor material is provided remote to the LED array. The same reference numerals as used in FIG. 1 are used to denote the same parts. In this embodiment the phosphor material is provided on a transparent plane 114 interposed between the LED array 108 and the secondary lens arrangement 116. The array of LEDs 108 now comprises blue/UV LED chips which do not include a phosphor (wavelength conversion) material. In one arrangement the plane of phosphor material 114 comprises a transparent sheet material, for example an acrylic material, polycarbonate material or glass, on to an inner or outer surface of which the phosphor material is deposited in the form of one or more layers. In an alternative arrangement the phosphor material can be incorporated within the transparent sheet material.

The phosphor which comprises an inorganic photo luminescent powdered material can for example be mixed with a transparent silicone or other binder material and the mixture then applied to the surface of the acrylic sheet by painting, screen printing or other deposition techniques. In alternative arrangements the phosphor can be incorporated into a transparent film and the film then applied to the transparent sheet material.

Alternatively or addition the phosphor material can be provided on a surface of, or incorporated within the material of, the front cover lens 104 or secondary lens arrangement 116 though such an arrangement can affect the optical function of these components and consequently they may require modification.

In contrast to the LEDs used in the signal lamp of FIG. 1 each of which incorporate a small surface area of phosphor, typically of order of a millimeter squared ($mm^2$) or so, in contact with the LED die/chip, the phosphor of the lamp of the invention of FIG. 3 is provided as a relatively large surface area, of the order of a thirty thousand $mm^2$ or more. As a result a signal lamp in accordance with FIG. 3 produces a substantially uniform illumination with no signs of pixelation compared with the known LED signal lamps. Moreover, the signal lamp of the invention reduces fabrication costs since a common lamp module can be constructed which utilizes a single color of LED, typically blue, and the signal lamp color is determined by the phosphor material inserted into the module.

Figure 4:
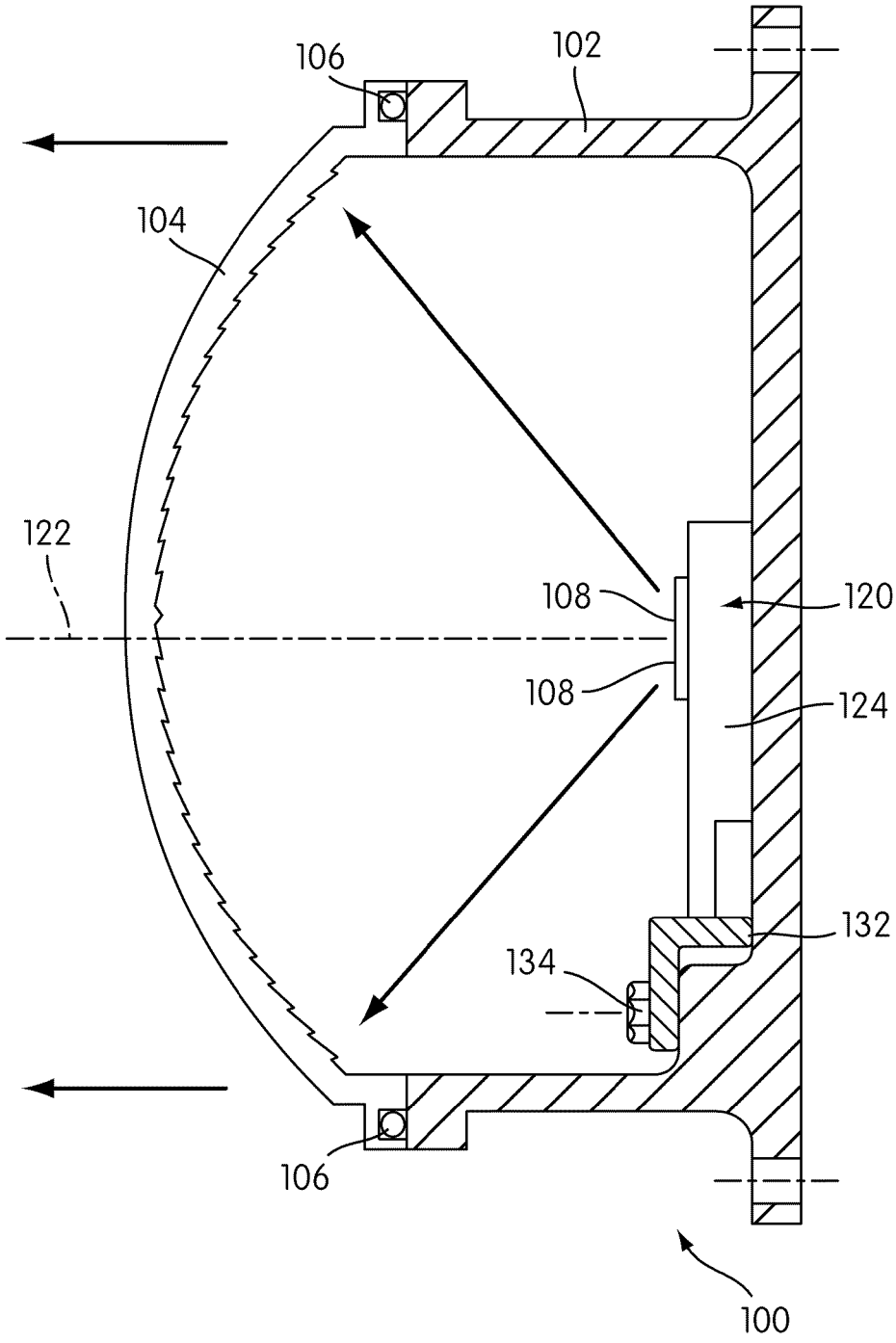
FIG. 4 is a schematic cross-sectional representation of a railway LED traffic light module in accordance with the invention.

Referring to FIG. 4 there is shown a railway signal lamp 100 in accordance with a further embodiment of the invention. In this embodiment the lamp includes a plug-in LED module 120 which is adapted to directly replace an incandescent bulb conventionally used in such lamps. The LED module 120 comprises an array of six high power (1 watt) LEDs 108. Typically each LED comprises an InGaN/GaN (indium gallium nitride/gallium nitride) based LED chip which generates blue/UV light of wavelength 400 to 450 nm/365 to 480 nm and includes a phosphor material which converts at least a part of the radiation (light) emitted by the chip into light of a longer wavelength. The light emitted by the chip combined with the light emitted by the phosphor gives the required color of emitted light. The LEDs 108 are grouped or clustered on a central axis 122 of the signal lamp. Since the LEDs are clustered they effectively operate as a point source and consequently there is no need for a secondary lens arrangement.

Figure 13:
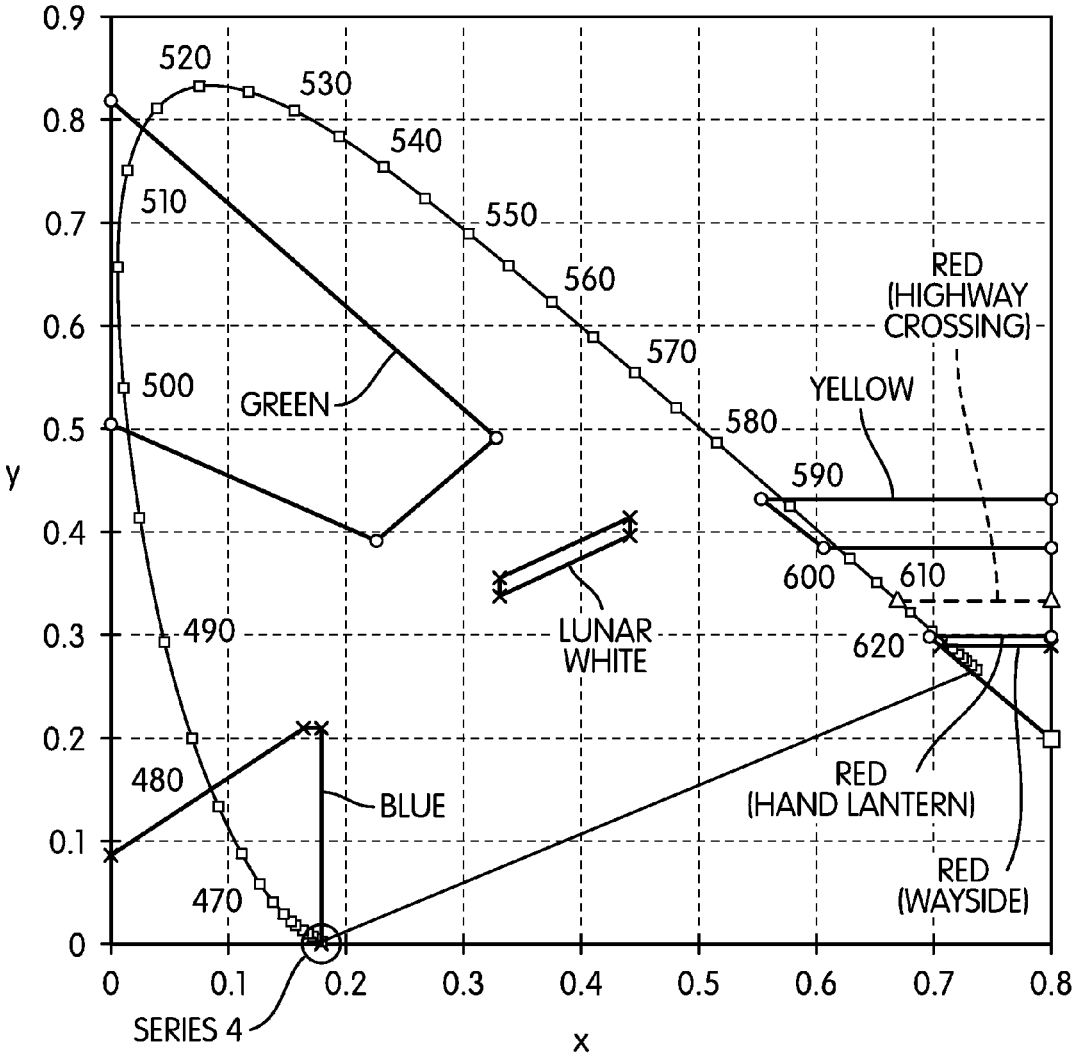
FIG. 13 is a CIE chromaticity diagram indicating the American Railway Engineering and Maintenance-of-way Association (AREMA) color signal specification.
Figure 14:
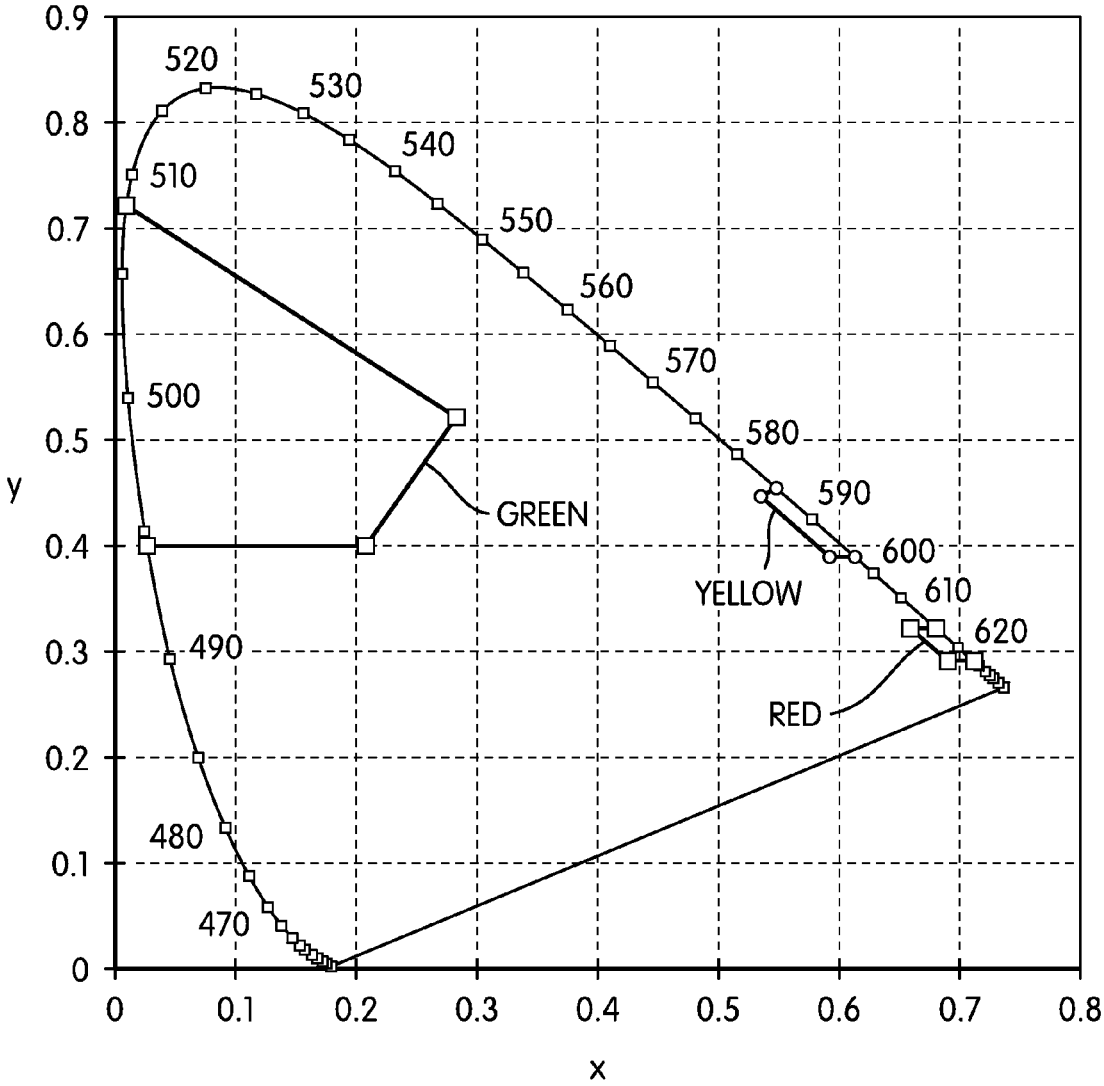
FIG. 14 is a CIE chromaticity diagram indicating the European Standard EN12368:2000 traffic signal color requirement.

The LED signal lamp of the invention can be configured as a red (610 nm), amber/yellow (590 nm), green (507 nm) or white signal lamp by appropriate selection of the phosphor material or a mixture of phosphor materials. FIG. 13 is a CIE chromaticity diagram indicating the American Railway Engineering and Maintenance-of-way Association (AREMA) color signal specification and Table 5 tabulates the color equations for the chromaticity diagram of FIG. 13. Signal lamps in accordance with the invention can be fabricated to meet the above specification by appropriate selection of the phosphor material/s and the number and intensity of LEDs used to excite the phosphor.

Figure 5:
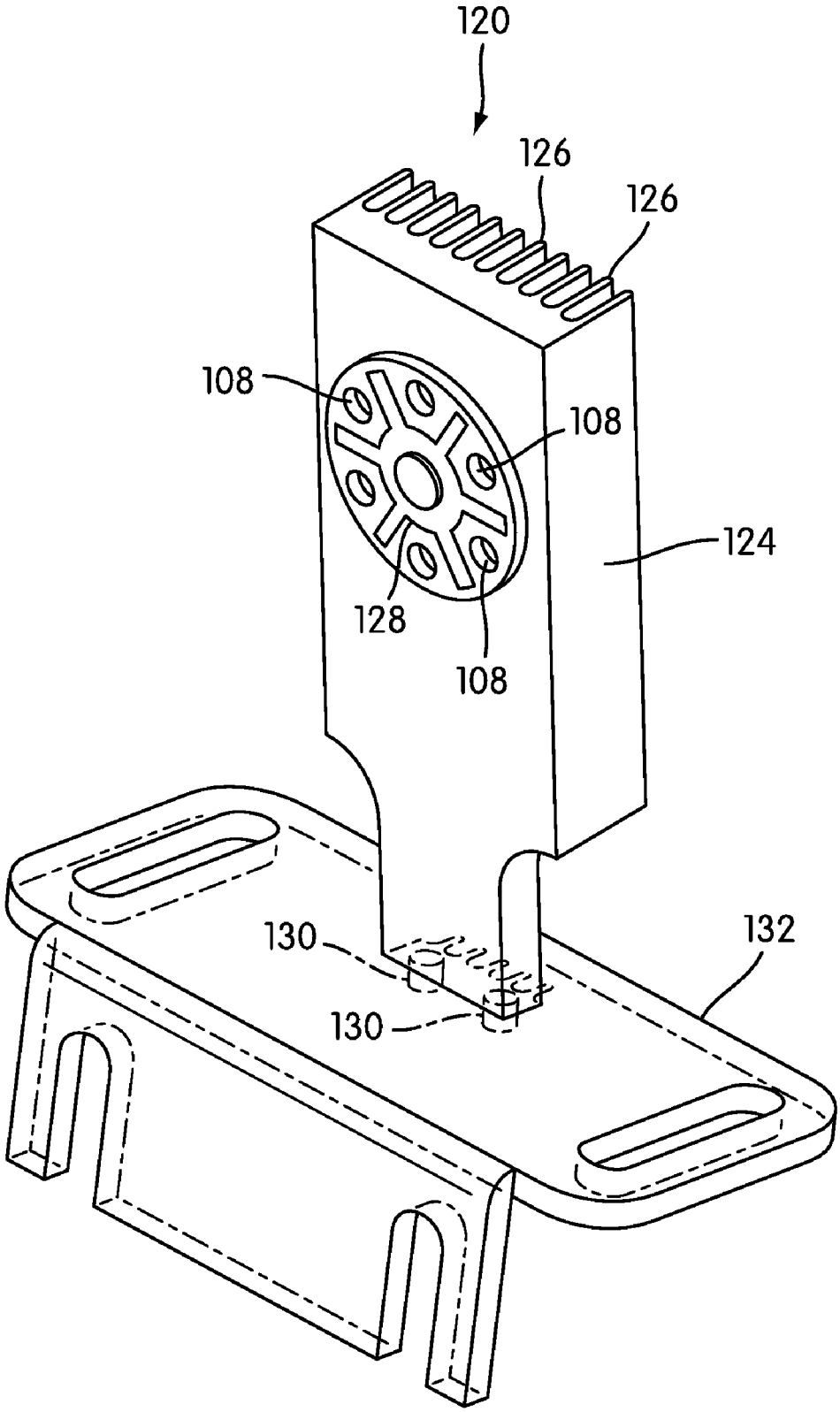
FIG. 5 is a perspective representation of a plug-in LED module for the railway traffic lights of FIGS. 4 and 6.

Referring to FIG. 5 there is shown is a perspective representation of the plug-in LED module 120 which comprises a thermally conducting body 124, which can be fabricated from aluminum and which has a series of heat radiating fins 126 provided on its rear face. The LEDs 108 are mounted around the periphery of a circular die or substrate 128 which is mounted in thermal communication with a front face of the body 124. Electrical connectors 130, for example electrically conducting pins, are provided on the body 124 and are configured to cooperate with corresponding sockets in a mounting bracket 132. The plug-in module 120 is configured such that it can be used to directly replace the incandescent bulb and holder in a conventional railway signal lamp. In operation the existing bulb/holder is removed and the mounting bracket 132 fixed in its place using the existing fixings 134 (bolts) within the housing and the plug-in module 120 then plugged into the bracket. Although not shown the body 124 can also include a power supply or driver circuitry to enable the module run off an existing supply such as for example 120 or 220V AC.

Figure 6:
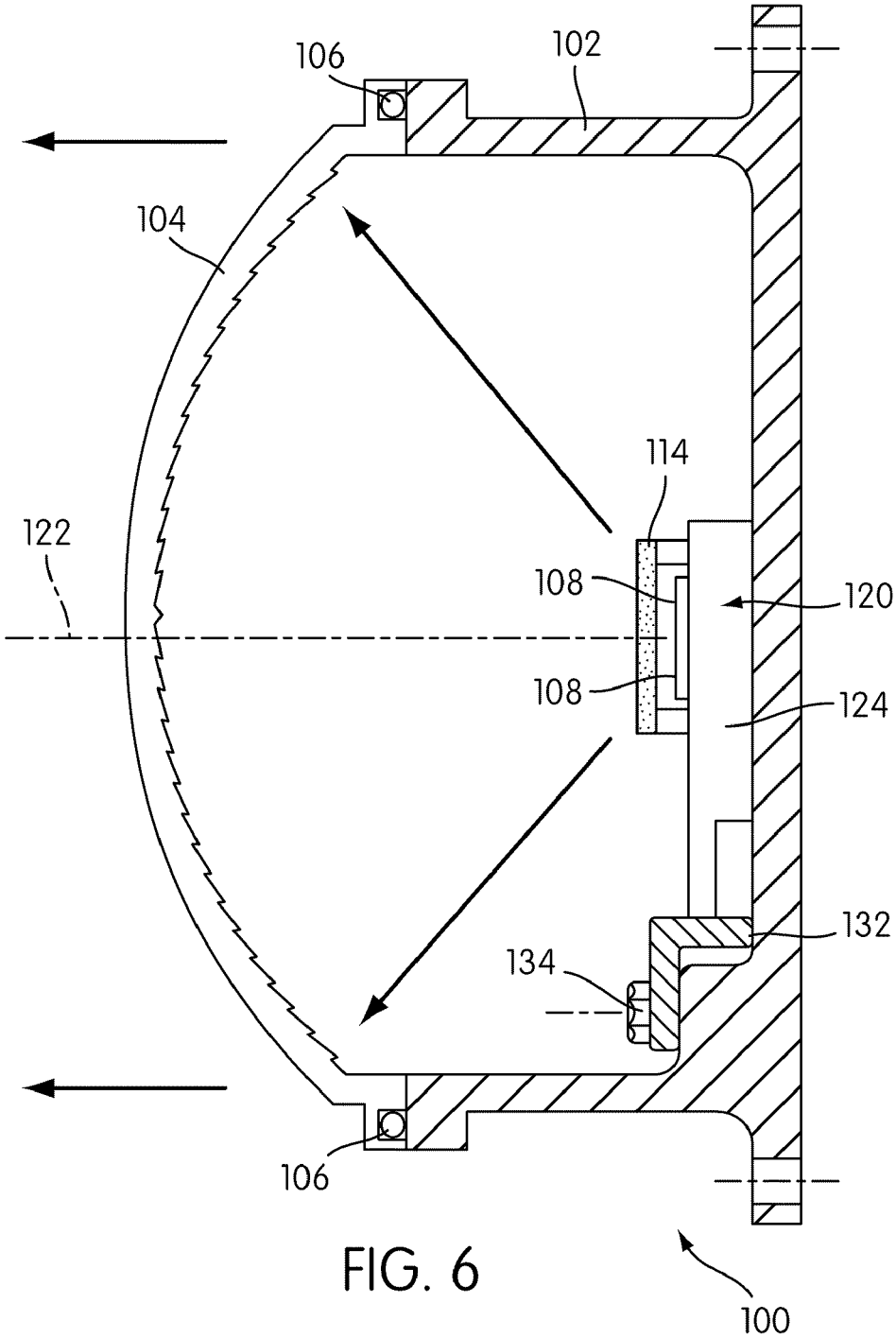
FIG. 6 is a schematic cross-sectional representation of a railway LED traffic light module in accordance with a further embodiment of the invention in which a phosphor material is provided remote to an LED excitation source.

FIG. 6 illustrates a railway signal lamp in accordance with the invention in which the phosphor material is provided remote to the LED array. The same reference numerals as used in FIG. 4 are used to denote the same parts. In this embodiment the phosphor material is provided on a transparent cover 114 mounted over the LED array 108. The array of LEDs 108 now comprises blue/UV LED chips which do not include a phosphor material. As with the signal lamp of FIG. 3 the phosphor material 114 can comprise a transparent sheet material, for example an acrylic material, polycarbonate material or glass, on to an inner or outer surface of which the phosphor material is deposited in the form of one or more layers. Alternatively the phosphor material can be incorporated within the transparent sheet material or provided on a surface of, or incorporated within the material of, the front cover lens 104.

Figure 7:
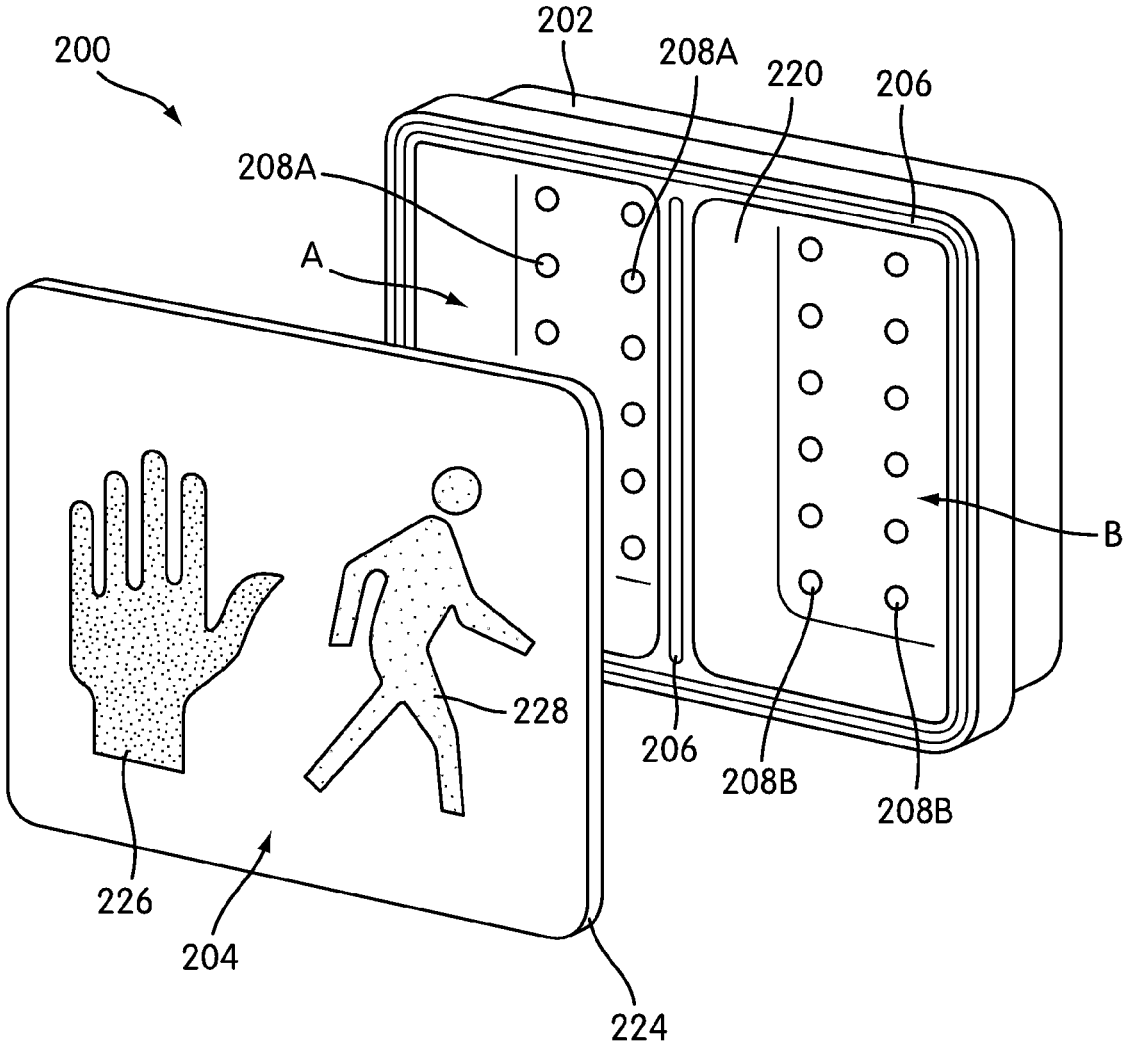
FIG. 7 is a schematic perspective exploded representation of a pedestrian crossing, wait-walk, signal lamp in accordance with the invention.

Referring to FIG. 7 there is shown a schematic perspective exploded representation of a pedestrian crossing, wait-walk, signal lamp 200 in accordance with the invention. Like reference numerals are used throughout the specification to denote like parts. The lamp 200 comprises a casing/housing 202, a front cover 204, a moisture seal 206 and two independently controllable arrays of LEDs 208A and 208B. Although not illustrated the signal lamp 200 can additionally include a respective circuit board on which each array of LEDs is mounted and a power supply/LED driver circuitry to enable the lamp to be operated from a 120/240V AC mains supply.

The casing 202 is divided into two sections A, B by a centre dividing wall/partition 220. Each housing section A, B houses a respective one of the LED arrays 208A and 208B. The LED array 208A comprises an array of blue/UV LED chips which include a red light emitting phosphor encapsulation. The LED array 208B comprises an array of blue LED chips which include a green or yellow/green light emitting phosphor encapsulation which in conjunction with the blue light emitted by the chip gives a combined light output which appears white in color.

The front cover 204 comprises a transparent plate 224, such as for example a transparent acrylic sheet, and has on its inner or outer surfaces an opaque, light blocking, coating which defines apertures/windows in the form of a required device/symbol 226, 228 overlying an associated section A, B. In the example of FIG. 4 the symbols comprise a raised hand device 226 and a walking pedestrian device 228. The transparent plate 224 can include a light diffusing material such as silicon dioxide or surface texturing to increase the uniformity of light output. Moreover, the front cover plate 224 can further include a complimentary color filter.

Figure 8:
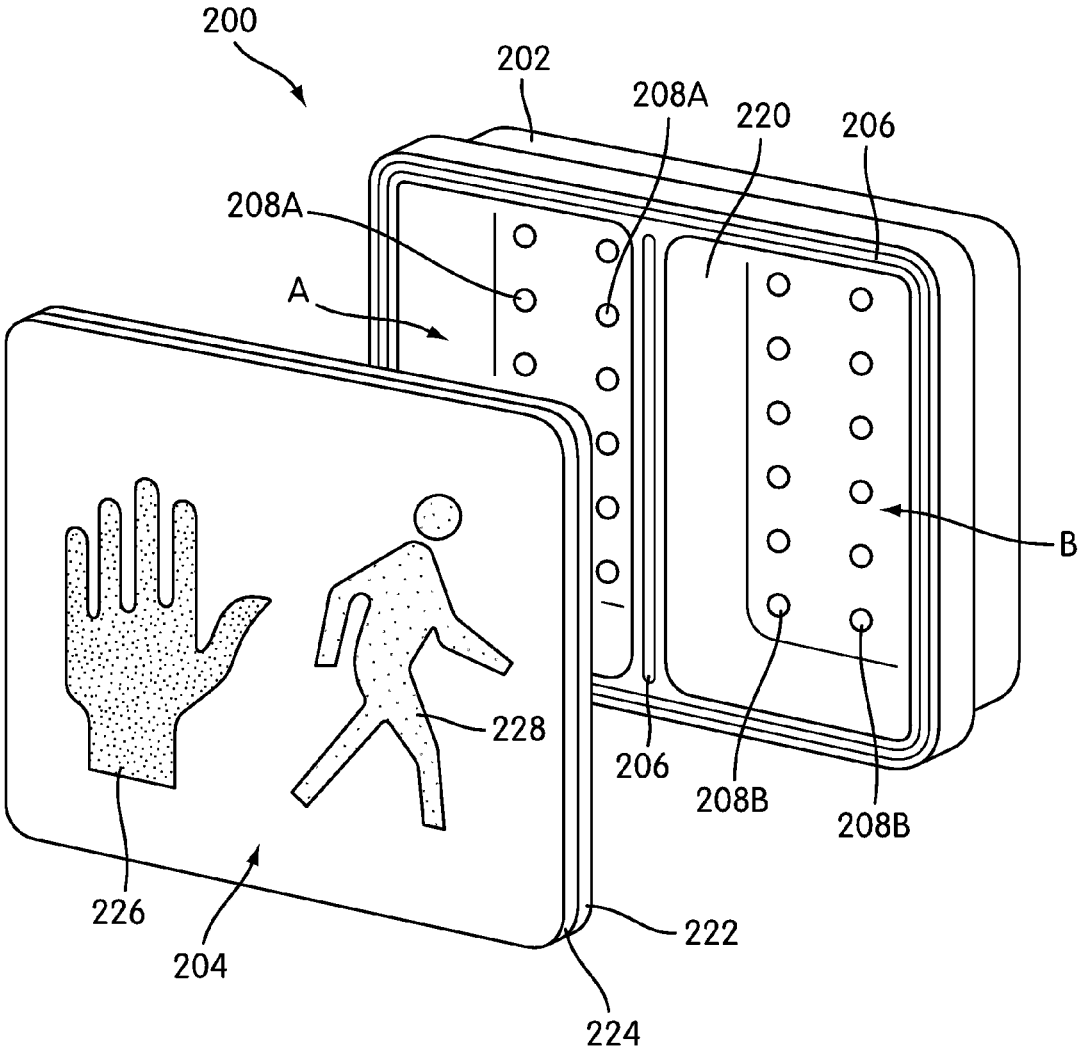
FIG. 8 is a schematic perspective exploded representation of a pedestrian signal lamp in accordance with a further embodiment of the invention in which a phosphor material is provided remote to an LED excitation source.
Figure 9:
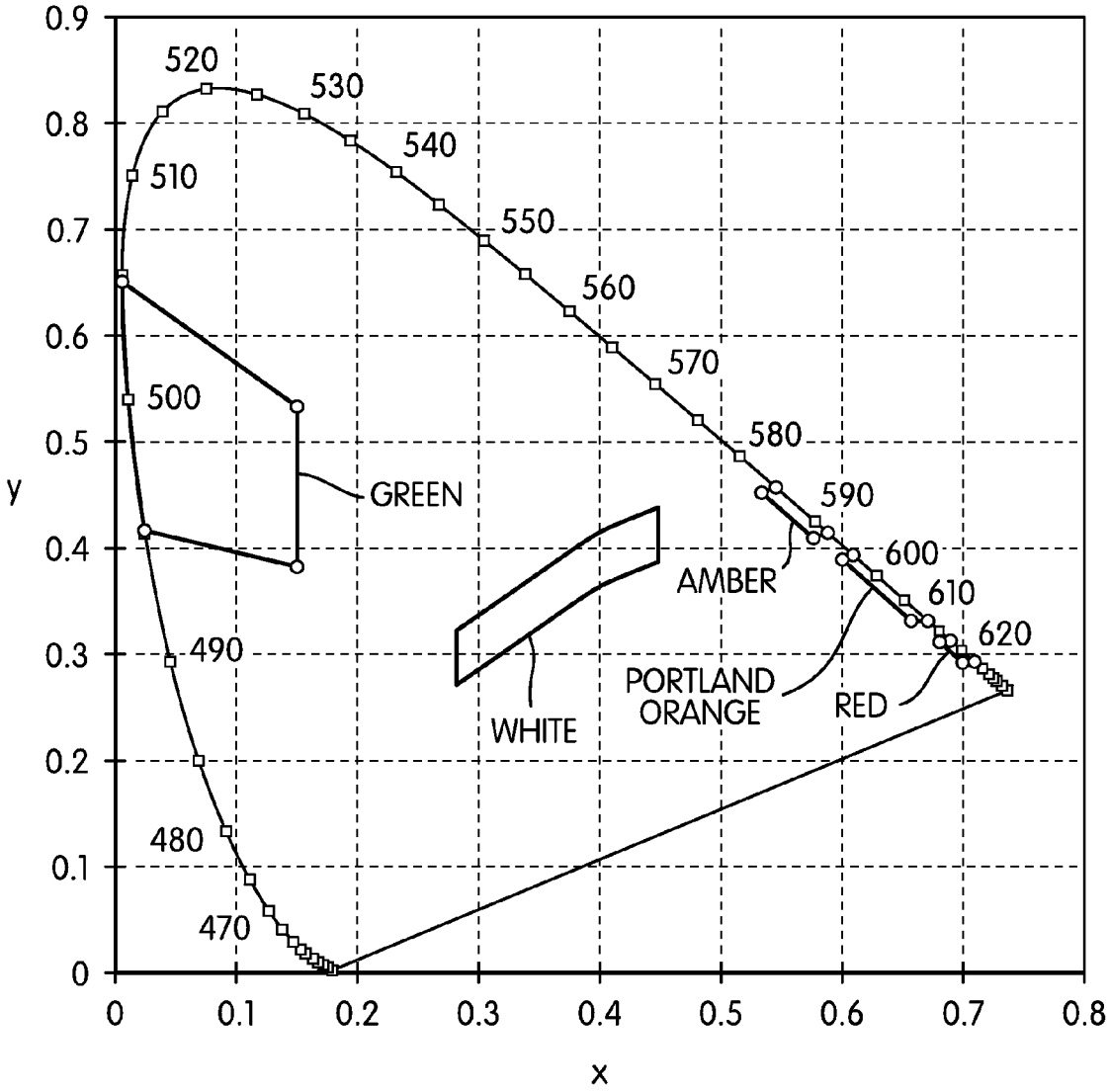
FIG. 9 is a CIE chromaticity diagram indicating Institute of Transportation Engineers (ITE) color specifications for vehicle and pedestrian traffic signals.
Figure 10:
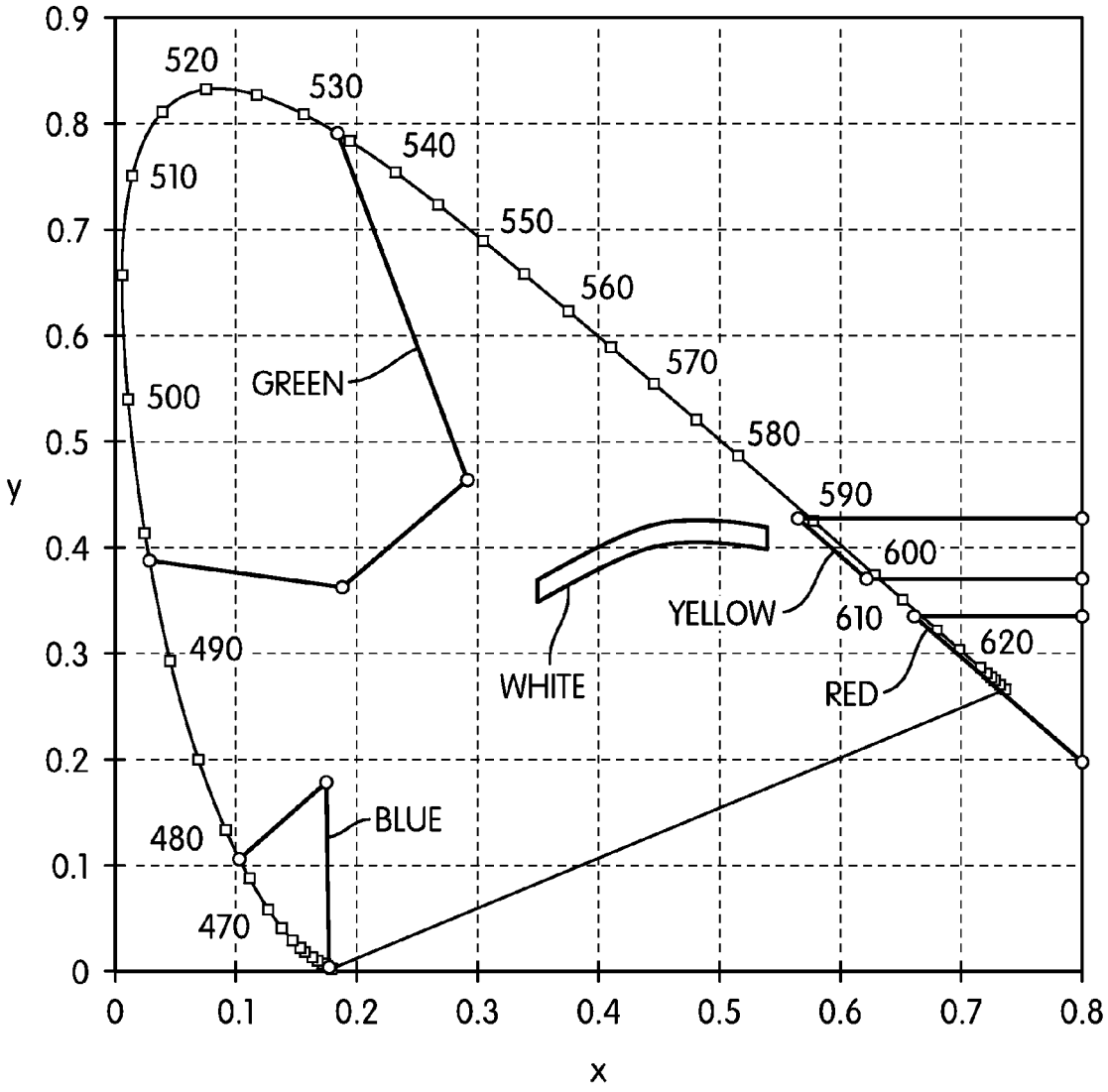
FIG. 10 is a CIE chromaticity diagram indicating Federal Aviation Administration (FAA) MIL-C-2505A aviation ground light colors.
Figure 11:
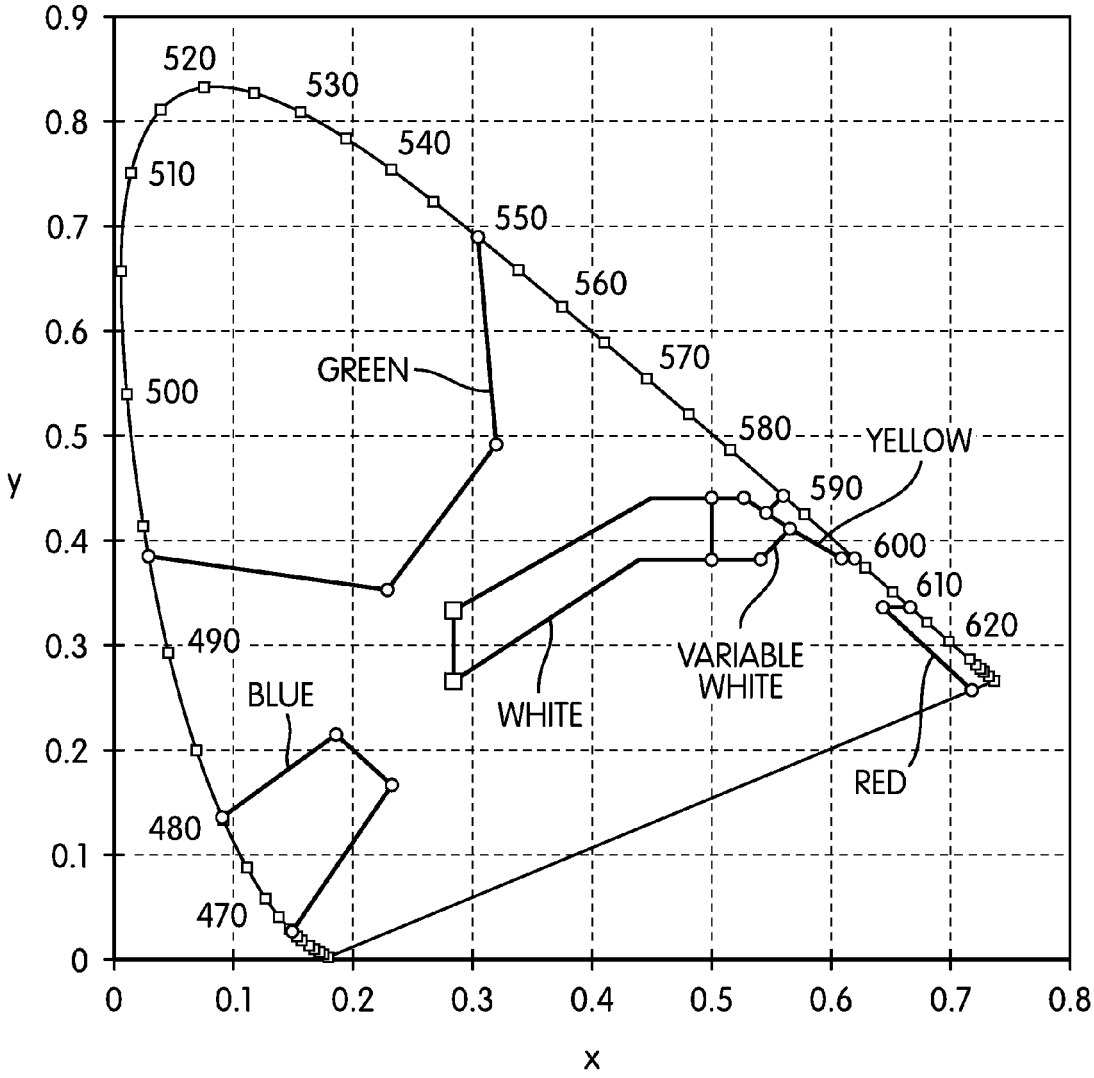
FIG. 11 is a CIE chromaticity diagram indicating International Civil Aviation Organization (ICAO) aeronautical ground light colors.
Figure 12:
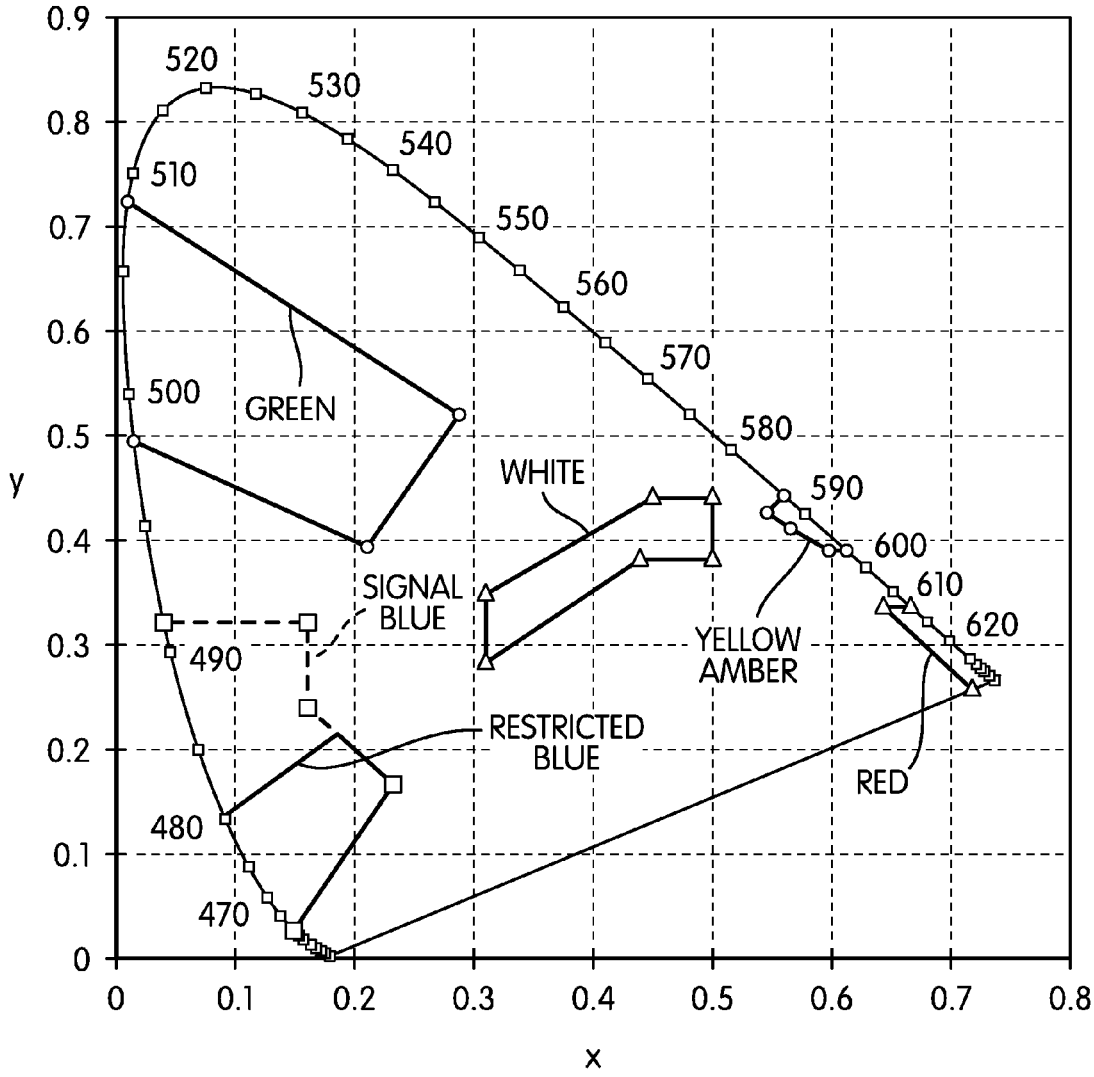
FIG. 12 is a CIE chromaticity diagram indicating Engineering society for advancing mobility land sea air and space (SAE) J578 ground vehicle lighting color standards.

Referring to FIG. 8 there is shown a schematic perspective exploded representation of a pedestrian signal lamp 200 in accordance with the invention in which the phosphor material is provided remote to the LED array. In this embodiment the front cover 204 comprises rear and front plates 222 and 224. On the rear plate 222, which can comprise a sheet of transparent material such as acrylic, respective phosphor materials are provided overlying an associated section A, B. The front plate 224, which can also comprise a transparent sheet such as acrylic, has on its inner or outer surfaces an opaque, light blocking, coating which defines one or more apertures/windows in the form of a required device/symbol 226, 228. In the example of FIG. 6 the symbols comprise a raised hand device 226 and a walking pedestrian device 228. The phosphor material corresponding to the raised hand device 226 comprises a red light emitting phosphor material and the phosphor material corresponding to the walking pedestrian device comprises a yellow or green light emitting phosphors or a mixture thereof which in conjunction with the blue light emitted by the activation LEDs produces light which appears white in appearance.

The signal lamp 200 of FIG. 7 or 8 advantageously further comprises a louvered cover grille over the front to limit the viewing angle of the lamp and to prevent glare from hindering viewing of the lamp in bright sunlight. Such grilles are well known in the art and often comprise a grille having diamond shaped apertures. Additionally the front plate 224 can be tinted to reduce glare and sun reflection and/or include a hard coating for abrasion resistance.

It will be appreciated that the present invention is not restricted to the specific embodiments described and that variations can be made that are within the scope of the invention. For example, for a signal lamp comprising a symbol or device such as the raised hand device, walking pedestrian device, arrow, cross etc. the phosphor can be provided in the form of the required symbol/device. The symbols can be readily fabricated by screen printing the phosphor material onto a transparent sheet material in the form of the symbol and screen printing surrounding areas screen printed with an opaque, light blocking, material/ink. The phosphor symbols/light blocking regions are advantageously printed on the inner surface of the front cover plate 224 to eliminate the need for the second cover plate 222. Such an arrangement provides the benefits of reducing the quantity of phosphor required and increasing the color uniformity of the signal lamp. Moreover, the array of LEDs is advantageously configured such as to substantially correspond to the symbol to which they activate.

TABLE 1

Institute of Transportation Engineers (ITE) color specifications for vehicle and pedestrian traffic signals

| Point | CIE x | CIE y | Equations |
|---|---|---|---|
| | | Current ITE Traffic (Red) | |
| 1 | 0.692 | 0.308 | y = 0.308 |
| 2 | 0.681 | 0.308 | y = 0.953 − 0.947x |
| 3 | 0.700 | 0.290 | y = 0.290 |
| 4 | 0.710 | 0.290 | |
| | | Current ITE Traffic (Amber) | |
| 1 | 0.545 | 0.454 | y = 0.151 + 0.556x |
| 2 | 0.536 | 0.449 | y = 0.972 − 0.976x |
| 3 | 0.578 | 0.408 | y = 0.235 + 0.300x |
| 4 | 0.588 | 0.411 | |
| | | Current ITE Traffic (Green) | |
| 1 | 0.005 | 0.651 | y = 0.655 − 0.831x |
| 2 | 0.150 | 0.531 | x = 0.150 |
| 3 | 0.150 | 0.380 | y = 0.422 − 0.278x |
| 4 | 0.022 | 0.416 | |
| | | Current ITE Traffic (Portland Orange) | |
| 1 | 0.6095 | 0.390 | y = 0.390 |
| 2 | 0.600 | 0.390 | 0.600 ≦ x ≦ 0.659 |
| 3 | 0.659 | 0.331 | y = 0.990 − x |
| 4 | 0.669 | 0.331 | y = 0.331 |
| | | Current ITE (White) | |
| 1 | 0.280 | 0.320 | Blue boundary: x = 0.280 |
| 2 | 0.400 | 0.415 | $1^{st}$ green boundary: 0.280 ≦ x ≦ 0.400; |
| 3 | 0.450 | 0.438 | y = 0.7917x + 0.0983 |
| 4 | 0.450 | 0.388 | $2^{nd}$ green boundary: 0.400 ≦ x ≦ 0.450; |
| 5 | 0.400 | 0.365 | y = 0.460x + 0.2310 |
| 6 | 0.280 | 0.270 | Yellow boundary: x = 0.450 |
| | | | $1^{st}$ purple boundary: 0.450 ≦ x ≦ 0.400; |
| | | | y = 0.460x + 0.181 |
| | | | $2^{nd}$ purple boundary: 0.400 ≦ x ≦ 0.280; |
| | | | y = 0.7917x + 0.0483 |

TABLE 2

Federal Aviation Administration (FAA) MIL-C-2505A aviation ground light colors

| Color boundary | Equation |
|---|---|
| MIL-C-25050A Red | |
| Yellow boundary | Y = 0.335 |
| Purple boundary | Y = 0.998 − x |
| MIL-C-25050A Yellow | |
| Red boundary | Y = 0.370 |
| Green boundary | y = 0.425 |
| White boundary | y = 0.993 − x |
| MIL-C-25050A Green | |
| Yellow boundary | x = 0.44 − 0.32y |
| White boundary | x = y − 0.170 |
| Blue boundary | y = 0.390 − 0.17x |
| MIL-C-25050A Blue | |
| Purple boundary | x = 0.175 |
| Green boundary | y = x |
| MIL-C-2505A White | |
| Yellow Boundary | x = 0.540 |
| Blue boundary | x = 0.350 |

TABLE 2-continued

| Federal Aviation Administration (FAA) MIL-C-2505A aviation ground light colors | |
|---|---|
| Color boundary | Equation |
| Green boundary | $y = y_0 + 0.01$ |
| Purple boundary | $y = y_0 - 0.01$ |

Where $y_0$ is the y coordinate on the plankian

TABLE 3

| International Civil Aviation Organization (ICAO) aeronautical Ground light colors | |
|---|---|
| Color boundary | Equation |
| ICAO Red | |
| Yellow boundary | y = 0.335 |
| Purple boundary | y = 0.980 − x |
| IICAO Yellow | |
| Red boundary | y = 0.382 |
| Green boundary | y = x − 0.120 |
| White boundary | y = 0.790 − 0.667x |
| IICAO Green | |
| Yellow boundary | x = 0.360 − 0.080y |
| White boundary | x = 0.650y |
| Blue boundary | y = 0.390 − 0.171x |
| IICAO Blue | |
| Purple boundary | x = 0.600y + 0.133 |
| Green boundary | y = 0.805x + 0.065 |
| White boundary | Y = 0.400 − x |
| IICAO White | |
| Yellow Boundary | x = 0.500 |
| Blue boundary | x = 0.285 |
| Green boundary | y = 0.440, y = 0.150 + 0.64x |
| Purple boundary | y = 0.050 + 0.750x, y = 0.382 |
| IICAO Variable white | |
| Yellow Boundary | x = 0.255 + 0.75y, x = 1.185 − 1.500y |
| Blue boundary | x = 0.285 |
| Green boundary | y = 0.440, y = 0.150 + 0.64x |
| Purple boundary | y = 0.050 + 0.750x, y = 0.382 |

TABLE 4

| Engineering society for advancing mobility land sea air and space (SAE) J578 ground vehicle lighting color standards | |
|---|---|
| Color boundary | Equation |
| Red | |
| Yellow boundary | y = 0.33 |
| Purple boundary | y = 0.98 − x |
| Yellow amber | |
| Red boundary | y = 0.39 |
| Green boundary | y = x − 0.12 |
| White boundary | y = 0.79 − 0.67x |
| Green | |
| Yellow boundary | y = 0.73 − 0.73x |
| White boundary | y = 0.63x − 0.04 |
| Blue boundary | y = 0.50 − 0.50x |
| White | |
| Yellow Boundary | x = 0.50 |
| Blue boundary | x = 0.31 |
| Green boundary | y = 0.15 + 0.64x |

TABLE 4-continued

| Engineering society for advancing mobility land sea air and space (SAE) J578 ground vehicle lighting color standards | |
|---|---|
| Color boundary | Equation |
| Purple boundary | y = 0.05 + 0.75x |
| Red boundary | y = 0.38 |
| Restricted Blue | |
| Green boundary | y = 0.07 + 0.81x |
| White boundary | x = 0.40 − y |
| Violet boundary | y = 0.13 + 0.60x |
| Signal Blue | |
| Green boundary | y = 0.32 |
| White boundary | x = 0.16, x = 0.40 − y |
| Violet boundary | X = 0.13 + 0.60y |

TABLE 5

| American Railway Engineering and Maintenance-of-way Association (AREMA) color signal specification | |
|---|---|
| Color boundary | Equation |
| Red (wayside) | |
| Yellow boundary | y = 0.288 |
| Purple boundary | y = 0.998 − x |
| Red (hand lantern) | |
| Yellow boundary | y = 0.296 |
| Purple boundary | y = 0.998 − x |
| Red (highway crossing) | |
| Yellow boundary | y = 0.330 |
| Purple boundary | y = 0.998 − x |
| Yellow | |
| Red boundary | y = 0.384 |
| Green boundary | y = 0.430 |
| White boundary | y = 0.862 − 0.783x, x = 0.554 |
| Green | |
| Yellow boundary | y = 0.817 − x |
| White boundary | y = 0.150 + 1.068x |
| Blue boundary | y = 0.506 − 0.519x |
| Lunar white | |
| Yellow Boundary | x = 0.441 |
| Blue boundary | x = 0.329 |
| Green boundary | y = 0.510x + 0.186 |
| Purple boundary | y = 0.170 + 0.510x |
| Blue | |
| Green boundary | y = 0.734x + 0.088 |
| White boundary | y = 0.209 |
| Purple boundary | y = 0.179 |
| | Tr/Tw ≦ 0.006 |

TABLE 6

| European Standard EN12368:2000 Traffic signal color requirement | |
|---|---|
| Color boundary | Equation |
| Red | |
| Red boundary | y = 0.290 |
| Yellow boundary | y = 0.320 |
| Purple boundary | y = 0.998 − x |

TABLE 6-continued

| European Standard EN12368:2000 Traffic signal color requirement | |
|---|---|
| Color boundary | Equation |
| Yellow | |
| Red boundary | y = 0.387 |
| Green boundary | y = 0.727x + 0.054 |
| White boundary | y = 0.980 − x |
| Green | |
| Yellow boundary | y = 0.726 − 0.726x |
| White boundary | y = 0.625 − 0.041 |
| Blue boundary | y = 0.400 |

TABLE 7

| Hi Flux LED module specifications | | | | |
|---|---|---|---|---|
| Color | Lens type | Dominant λ (nm) | Typical wattage @ 25° C. | Peak minimum maintained luminance intensity (cd) |
| 8" (200 mm) 120 V AC signal module | | | | |
| Red | Tinted | 625 | 6 | 165 |
| Yellow | Tinted | 590 | 13 | 410 |
| Green | Tinted | 500 | 6 | 215 |
| Green | Clear | 500 | 6 | 215 |
| 12" (300 mm) 120 V AC signal module | | | | |
| Red | Tinted | 625 | 9 | 365 |
| Yellow | Tinted | 590 | 16 | 910 |
| Green | Tinted | 500 | 12 | 475 |
| Green | Clear | 500 | 12 | 475 |

TABLE 8

| 12 V LED module specifications | | | | |
|---|---|---|---|---|
| Color | Lens type | Dominant λ (nm) | Typical wattage @ 25° C. | Minimum luminance intensity (cd) |
| 8" (200 mm) signal module | | | | |
| Red | Tinted | 622 | 9 | 127 |
| Yellow | Tinted | 590 | 13 | 267 |
| Green | Clear | 505 | 4 | 251 |
| 12" (300 mm) signal module | | | | |
| Red | Tinted | 622 | 18 | 319 |
| Yellow | Tinted | 590 | 25 | 678 |
| Green | Clear | 505 | 10 | 639 |

What is claimed is:

1. An LED signal lamp comprising: a housing, an LED excitation source operable to emit excitation radiation of a first wavelength range, at least one phosphor material for converting at least a part of the excitation radiation to light of a selected wavelength range and a substantially transparent cover provided on the housing opening, wherein the LED excitation source comprises a plurality of LEDs that are grouped to effectively operate as a point source.

2. The signal lamp according to claim 1, wherein the LED excitation source incorporates the at least one phosphor material.

3. The signal lamp according to claim 1, wherein the at least one phosphor material is provided remote to the LED excitation source.

4. The signal lamp according to claim 3, wherein the phosphor is disposed between the LED excitation source and the transparent cover.

5. The signal lamp according to claim 4, wherein the phosphor is provided on a transparent substrate which is disposed between the excitation source and the transparent cover.

6. The signal lamp according to claim 5, wherein the phosphor is provided as a layer on a surface of the transparent substrate.

7. The signal lamp according to claim 5, wherein the phosphor is incorporated in the substrate material.

8. The signal lamp according to claim 5, wherein the at least one phosphor material is provided over a surface area of at least thirty thousand square millimeters.

9. The signal lamp according to claim 3, wherein the phosphor is provided on the transparent cover.

10. The signal lamp according to claim 8, wherein the phosphor is incorporated in the cover material.

11. The signal lamp according to claim 10, wherein the optical condenser comprises a lens structure formed on a surface of the transparent cover.

12. The signal lamp according to claim 9, wherein the phosphor is provided as a layer on a surface of the cover.

13. The signal lamp according to claim 12, wherein the phosphor defines a device or symbol.

14. The signal lamp according to claim 1, and further comprising an optical condenser for focusing light emitted by the lamp.

15. The signal lamp according to claim 14, and further comprising an optical element disposed between the phosphor and cover, the optical element configured in conjunction with the lens structure to direct light in a desired direction or pattern.

16. The signal lamp according to claim 1, wherein the excitation source comprises a blue/UV emitting LED.

17. The signal lamp according to claim 16, wherein the lamp is configured to generate light selected from the group consisting of: red light, orange light, amber light, green light, white light and blue light.

18. The signal lamp according to claim 1, wherein the phosphor is selected from the group consisting of: a silicate-based phosphors of general composition $A_3Si(O,D)_5$ and $A_2Si(O,D)_4$ where A=Sr, Ba, Mg or Ca and D=Cl, Fl, N or S; an aluminate-based phosphor; a nitride phosphor; a sulfate phosphor; an oxy-nitride phosphor; an oxy-sulfate phosphor and a garnet material (YAG).

19. The signal lamp according to claim 1 and selected from the group consisting of a vehicle traffic signal, a pedestrian traffic signal, a railway traffic signal, an aeronautical ground light and aviation ground light.

20. The signal lamp according to claim 1, wherein the plurality of LEDs is grouped on a central axis of the lamp.

21. The signal lamp according to claim 1, wherein in operation the lamp has an output power selected from the group consisting of being at least: 4 w, 6 W, 9 W, 10 W, 12 W, 13 W, 16 W, 18 W, 24 W and 25 W.

22. The signal lamp according to claim 1, wherein the at least one phosphor material is of formula $(Sr_{1-x}M_x)_yEu_zSiO_5$ in which M is at least one of a divalent metal selected from the group consisting of Ba, Mg, Ca and Zn, $0<x<0.5$; $2.6<y<3.3$; and $0.001<z<0.5$.

23. The signal lamp according to claim 22, wherein the at least one phosphor material is configured to emit amber light having a peak emission wavelength greater than about 565 nm.

24. An amber signal lamp comprising: a housing, at least one LED operable to emit excitation radiation of a first wavelength range, at least one phosphor material for converting the excitation radiation to amber light and a substantially transparent cover provided on the housing opening, wherein the LED excitation source comprises a plurality of LEDs that are grouped such as to effectively operate as a point source.

25. The signal lamp according to claim 24, wherein the at least one phosphor material is of formula $(Sr_{1-x}M_x)_yEu_zSiO_5$ in which M is at least one of a divalent metal selected from the group consisting of Ba, Mg, Ca and Zn, $0<x<0.5$; $2.6<y<3.3$; and $0.001<z<0.5$.

26. The signal lamp according to claim 25, wherein the at least one phosphor material is configured to amber light having a peak emission wavelength greater than about 565 nm.

27. The signal lamp according to claim 25, wherein the at least one phosphor material is selected from the group consisting of: being incorporated in the at least one LED; being provided remote to the at least one LED; being provided remote to the at least one LED and disposed between the at least one LED source and the transparent cover; being provided as a layer on a surface of a transparent substrate disposed between the at least one LED source and the transparent cover; being incorporated in a transparent substrate disposed between the at least one LED source and the transparent cover; being provided as layer on the transparent cover; and being incorporated in the transparent cover.

28. The signal lamp according to claim 27, wherein the at least one phosphor material is provided over a surface area of at least thirty thousand square millimeters.

29. The signal lamp according to claim 24, wherein the at least one LED excitation source comprises a plurality of LEDs that are grouped such as to effectively operate as a point source.

30. The signal lamp according to claim 29, wherein the plurality of LEDs is grouped on a central axis of the lamp.

* * * * *